US008969273B2

(12) United States Patent
Tobias et al.

(10) Patent No.: US 8,969,273 B2
(45) **Date of Patent: *Mar. 3, 2015**

(54) LUBRICATING OIL COMPOSITIONS

(75) Inventors: Melanie F. Tobias, Pleasant Hill, CA (US); Jon F. Von Staden, San Antonio, TX (US)

(73) Assignee: Chevron Oronite Company LLC, San Ramon, CA (US)

( * ) Notice: Subject to any disclaimer, the term of this patent is extended or adjusted under 35 U.S.C. 154(b) by 354 days.

This patent is subject to a terminal disclaimer.

(21) Appl. No.: 12/378,679

(22) Filed: Feb. 18, 2009

(65) Prior Publication Data

US 2010/0210493 A1 Aug. 19, 2010

(51) Int. Cl.

| | |
|---|---|
| ***C09K 15/08*** | (2006.01) |
| ***C10M 169/04*** | (2006.01) |
| ***C10M 137/10*** | (2006.01) |
| ***C07C 309/62*** | (2006.01) |
| ***C10M 129/76*** | (2006.01) |
| ***C10M 129/54*** | (2006.01) |
| ***C10M 135/10*** | (2006.01) |
| ***C10M 159/20*** | (2006.01) |
| ***C10M 159/22*** | (2006.01) |
| ***C10M 159/24*** | (2006.01) |

(52) U.S. Cl.

CPC ..... *C10M 129/54* (2013.01); *C10M 135/10* (2013.01); *C10M 159/20* (2013.01); *C10M 159/22* (2013.01); *C10M 159/24* (2013.01); *C10M 2207/026* (2013.01); *C10M 2207/144* (2013.01); *C10M 2207/262* (2013.01); *C10M 2207/289* (2013.01); *C10M 2215/28* (2013.01); *C10M 2219/022* (2013.01); *C10M 2219/044* (2013.01); *C10M 2219/046* (2013.01); *C10M 2219/102* (2013.01); *C10M 2223/045* (2013.01); *C10N 2230/06* (2013.01); *C10N 2230/40* (2013.01); *C10N 2230/45* (2013.01); *C10N 2240/10* (2013.01)

USPC ..... 508/585; 508/287; 508/370; 508/390; 508/502; 508/584

(58) Field of Classification Search

USPC ..... 508/585, 287, 110, 390, 502, 584, 370

See application file for complete search history.

(56) References Cited

U.S. PATENT DOCUMENTS

| | | | |
|---|---|---|---|
| 2,202,781 | A | 5/1939 | Kennedy |
| 2,174,110 | A | 9/1939 | Reed |
| 2,174,506 | A | 9/1939 | Fox |
| 2,174,508 | A | 9/1939 | Fox |
| 2,193,824 | A | 3/1940 | Lockwood et al. |
| 2,197,800 | A | 4/1940 | Henke et al. |
| 2,197,832 | A | 4/1940 | Reiff |
| 2,197,835 | A | 4/1940 | Reiff |
| 2,212,786 | A | 8/1940 | McQueen |
| 2,213,360 | A | 9/1940 | Calcott et al. |
| 2,223,676 | A | 12/1940 | Dinsmure et al. |
| 2,228,598 | A | 1/1941 | Fox et al. |
| 2,239,974 | A | 4/1941 | Reed et al. |
| 2,252,662 | A | 8/1941 | Reiff |
| 2,252,664 | A | 8/1941 | Reiff |
| 2,276,090 | A | 3/1942 | Reed |
| 2,276,097 | A | 3/1942 | Salzberg |
| 2,315,514 | A | 4/1943 | Fox |
| 2,319,121 | A | 5/1943 | Fox |
| 2,321,022 | A | 6/1943 | Fox |
| 2,333,568 | A | 11/1943 | Henke et al. |
| 2,333,788 | A | 11/1943 | Holbrook et al. |
| 2,335,259 | A | 11/1943 | Calcott |
| 2,337,552 | A | 12/1943 | Henke |
| 2,347,568 | A | 4/1944 | Kunert |
| 2,366,027 | A | 12/1944 | Henke |
| 2,374,193 | A | 4/1945 | Grubb |
| 2,383,319 | A | 8/1945 | Kharasch |
| 2,501,731 | A | 3/1950 | Mertes |
| 2,616,904 | A | 11/1952 | Asseff et al. |
| 2,616,905 | A | 11/1952 | Asseff et al. |
| 2,616,906 | A | 11/1952 | Asseff et al. |
| 2,616,911 | A | 11/1952 | Asseff |
| 2,616,924 | A | 11/1952 | Asseff et al. |
| 2,616,925 | A | 11/1952 | Asseff et al. |
| 2,617,049 | A | 11/1952 | Asseff et al. |
| 2,680,096 | A | 6/1954 | Walker et al. |
| 2,714,092 | A | 7/1955 | Colnane et al. |
| 2,777,874 | A | 1/1957 | Asseff et al. |
| 3,027,325 | A | 3/1962 | McMillen et al. |
| 3,036,003 | A | 5/1962 | Verdol |
| 3,036,971 | A | 5/1962 | Otto |
| 3,172,892 | A | 3/1965 | Le Suer et al. |
| 3,219,666 | A | 11/1965 | Norman et al. |
| 3,256,186 | A | 6/1966 | Greenwald |

(Continued)

FOREIGN PATENT DOCUMENTS

| | | |
|---|---|---|
| EP | 1104800 A2 | 0/2001 |
| JP | 2927530 | 7/1999 |
| JP | 2005/162968 | 6/2005 |
| WO | WO 2010/009036 | 1/2010 |

OTHER PUBLICATIONS

Office Action issued in counterpart Japanese Patent Application No. 2011-551185.

*Primary Examiner* — Vishal Vasisth

(57) ABSTRACT

A method for preventing or inhibiting exhaust valve seat recession in a natural gas fueled engine, the method comprising lubricating the engine with a natural gas engine lubricating oil composition comprising (a) a major amount of an oil of lubricating viscosity; and (b) an alkali metal-containing detergent, wherein the natural gas engine lubricating oil composition is substantially free of each of any alkaline earth metal-containing detergents and lithium-containing detergents is disclosed.

8 Claims, No Drawings

(56) References Cited

U.S. PATENT DOCUMENTS

| | | | | |
|---|---|---|---|---|
| 3,271,130 | A | 9/1966 | Denig | |
| 3,272,746 | A | 9/1966 | Le Suer et al. | |
| 3,275,554 | A | 9/1966 | Wagenaar | |
| 3,282,835 | A | 11/1966 | Asseff | |
| 3,312,618 | A | 4/1967 | Le Suer et al. | |
| 3,318,809 | A | 5/1967 | Bray | |
| 3,320,162 | A | 5/1967 | Axe et al. | |
| 3,329,658 | A | 7/1967 | Fields | |
| 3,342,733 | A | 9/1967 | Robbins et al. | |
| 3,350,038 | A | 10/1967 | Oberlander | |
| 3,368,396 | A | 2/1968 | Burkleo et al. | |
| 3,373,108 | A | 3/1968 | Woodle et al. | |
| 3,384,585 | A | 5/1968 | Gragson et al. | |
| 3,410,798 | A | 11/1968 | Cohen | |
| 3,438,757 | A | 4/1969 | Honnen et al. | |
| 3,449,250 | A | 6/1969 | Fields | |
| 3,454,555 | A | 7/1969 | Vander Voort | |
| 3,471,403 | A | 10/1969 | Le Suer et al. | |
| 3,488,284 | A | 1/1970 | Le Suer et al. | |
| 3,523,082 | A | 8/1970 | Vienna et al. | |
| 3,565,804 | A | 2/1971 | Honnen et al. | |
| 3,567,637 | A | 3/1971 | Nishijima et al. | |
| 3,586,629 | A | 6/1971 | Otto et al. | |
| 3,591,598 | A | 7/1971 | Traise et al. | |
| 3,595,790 | A | 7/1971 | Norman | |
| 3,595,791 | A | 7/1971 | Cohen | |
| 3,629,109 | A | 12/1971 | Gergel et al. | |
| 3,632,610 | A | 1/1972 | Schmitz | |
| 3,666,730 | A | 5/1972 | Coleman | |
| 3,775,321 | A | 11/1973 | Turnquest et al. | |
| 3,798,012 | A | 3/1974 | Le Suer | |
| 3,798,163 | A | 3/1974 | Palmer | |
| 3,980,569 | A | 9/1976 | Pindar et al. | |
| 4,234,435 | A | 11/1980 | Meinhardt et al. | |
| 4,612,132 | A | 9/1986 | Wollenberg et al. | |
| 4,746,446 | A | 5/1988 | Wollenberg et al. | |
| 5,726,133 | A | 3/1998 | Blahey et al. | |
| 6,001,780 | A | 12/1999 | Ho et al. | |
| 6,165,235 | A | 12/2000 | Kolp et al. | |
| 6,174,842 | B1 | 1/2001 | Gatto et al. | |
| 2,263,312 | A1 | 11/2001 | Reed | |
| 6,372,696 | B1 | 4/2002 | Tipton | |
| 6,440,905 | B1 | 8/2002 | Epps et al. | |
| 6,596,672 | B1 | 7/2003 | Carrick et al. | |
| 6,642,191 | B2 | 11/2003 | Palazzotto et al. | |
| 6,727,208 | B2 | 4/2004 | Wilk | |
| 6,756,348 | B2 | 6/2004 | Palazzotto et al. | |
| 2002/0142922 | A1 | 10/2002 | Yagishita et al. | |
| 2003/0134756 | A1 | 7/2003 | Carrick et al. | |
| 2004/0142827 | A1 | 7/2004 | Palazzotto et al. | |
| 2005/0107269 | A1* | 5/2005 | Yagishita et al. | 508/440 |
| 2005/0137098 | A1 | 6/2005 | Le Cuent et al. | |
| 2005/0137100 | A1* | 6/2005 | Le Coent et al. | 508/518 |
| 2005/0148477 | A1* | 7/2005 | Friend et al. | 508/291 |
| 2007/0027043 | A1 | 2/2007 | Le Cuent | |
| 2007/0111904 | A1 | 5/2007 | Van Dam | |
| 2007/0129263 | A1 | 6/2007 | Boffa et al. | |
| 2007/0142239 | A1 | 6/2007 | Boffa et al. | |
| 2008/0076686 | A1 | 3/2008 | Nakazato et al. | |

* cited by examiner

LUBRICATING OIL COMPOSITIONS

BACKGROUND OF THE INVENTION

1. Technical Field

The present invention generally relates to a lubricating oil composition.

2. Description of the Related Art

Natural gas fueled engines are engines that use natural gas as a fuel source. Lubricating oils with high resistance to oxidation, nitration and viscosity increase are generally preferred for lubricating oils used in natural gas engines because of the conditions related to this type of engine.

Natural gas has a higher specific heat content than liquid hydrocarbon fuels and therefore it will burn hotter than liquid hydrocarbon fuels under typical conditions. In addition, since it is already a gas, natural gas does not cool the intake air by evaporation as compared to liquid hydrocarbon fuel droplets. Furthermore, many natural gas fueled engines are run either at or near stoichiometric conditions, where less excess air is available to dilute and cool combustion gases. As a result, natural gas fueled engines generate higher combustion gas temperatures than engines burning liquid hydrocarbon fuels. In most cases, natural gas fueled engines are used continuously at 70 to 100% load, whereas an engine operating in vehicular service may only spend 50% of its time at full load.

This condition of running continuously near full load places severe demands on the lubricant. For example, by subjecting the lubricating to a sustained high temperature environment, the life of the lubricant is often limited by oil oxidation processes. Also, since the rate of formation of nitrogen (NOx), increases exponentially with temperature, natural gas fueled engines may generate $NO_x$ concentrations high enough to cause severe nitration of lubricating oil.

Good valve wear control is also important for keeping engine operating costs down and may be achieved by providing the proper amount and composition of ash. In addition, minimizing combustion chamber deposits and spark plug fouling are considerations in setting the ash content in these oils. Lubricating oil ash levels are limited, so detergents must be carefully selected to minimize piston deposits and ring sticking.

Valve wear resistance is important to the durability of natural gas fueled engines. In general, exhaust valve recession is wear which occurs at the valve and valve seat interface and is the most pronounced form of valve wear in natural gas fueled engines. When the valve is prevented from seating properly, it can cause engine roughness, poor fuel economy and excessive emissions. In order to correct excessive valve wear, a cylinder head overhaul is usually required. Although natural gas fueled engines typically use very hard corrosion-resistant material for the valve face and seat mating surface to give extended cylinder head life, it does not completely eliminate valve recession.

There is a difference in the lubricating oil requirements for natural gas fueled engines and engines that are fueled by liquid hydrocarbon fuels. The combustion of liquid hydrocarbon fuels such as diesel fuel often results in a small amount of incomplete combustion (e.g., exhaust particulates). In a liquid hydrocarbon fueled engine, these incombustibles provide a small but critical degree of lubrication to the exhaust valve/seat interface, thereby ensuring the durability of both cylinder heads and valves.

Natural gas fueled engines burn fuel that is introduced to the combustion chamber in the gaseous phase. The combustion of natural gas fuel is often very complete, with virtually no incombustible materials. This has a significant affect on the intake and exhaust valves because there is no fuel-derived lubricant such as liquid droplets or soot to aid in lubrication to the exhaust valve/seat interface in a natural gas fueled engine. Therefore, the durability of the cylinder head and valve is controlled by the ash content and other properties of the lubricating oil and its consumption rate to provide lubricant between the hot valve face and its mating seat. Too little ash or the wrong type can accelerate valve and seat wear, while too much ash may lead to valve guttering and subsequent valve torching. Too much ash can also lead to loss of compression or detonation from combustion chamber deposits. Consequently, gas engine builders frequently specify a narrow ash range that they have learned provides the optimum performance. Since most gas is low in sulfur, excess ash is generally not needed to address alkalinity requirements, and ash levels are largely optimized around the needs of the valves. There may be exceptions to this in cases where sour gas or landfill gas is used.

U.S. Pat. No. 3,798,163 ("the '163 patent") discloses a lubricating oil composition containing (a) a major amount of an oil of lubricating viscosity, (b) at least one alkaline earth metal sulfonate in an amount sufficient to improve the detergency of the composition, and (c) at least one alkaline earth metal salt of a condensation product of (i) an alkylene polyamine, (ii) an aldehyde, and (iii) a substituted phenol, wherein the alkaline earth metal salt is present in an amount sufficient to inhibit the recession of the engine's exhaust valves into the engine cylinder head.

U.S. Pat. No. 5,726,133 ("the '133 patent") discloses a low ash gas engine oil comprising a major amount of a base oil of lubricating viscosity and a minor amount sufficient to contribute a sulfated ash content of about 0.1 to 0.6% ash by ASTM D 874 of an additive mixture comprising a mixture of detergents comprising at least one first alkali or alkaline earth metal salt or mixture thereof of low Base Number (BN) of about 250 and less and at least one second alkali or alkaline earth metal salt or mixture thereof which is more neutral than the first low BN salt. The '133 patent further discloses that the fully formulated gas engine oil can also typically contain other standard additives known to those skilled in the art, including antiwear additives such as zinc dithiophosphates, dispersants, phenolic or aminic antioxidants, metal deactivators, pour point depressants, antifoaming agents, and viscosity index improvers.

U.S. Patent Application Publication No. 20050137098 ("the '098 application") discloses alkali metal overbased detergents as lubricating oil additives effective for the lubrication of engines such as diesel or gasoline engines, whether these engines are two stroke or four stroke. The '098 application further disclose that the overbased detergents are effective for the lubrication of mechanical components in land and marine engines, such as hydraulic systems, transmissions, two-stroke and four-stroke vehicular engines, trunk piston and two-stroke crosshead marine engines. The alkali metal overbased detergents may be sulfurized and may comprise at least 80 weight percent alkylhydroxybenzoate and the preferred alkali metal is potassium.

U.S. Patent Application Publication No. 20070129263 ("the '263 application") discloses a lubricating oil composition containing (a) a major amount of an oil of lubricating viscosity (b) one or more lithium-containing detergents (c) one or more detergents other than a lithium-containing detergent (d) one or more antioxidants (e) one or more dispersants and (f) one or more anti-wear agents, wherein the lubricating oil composition contains no more than 0.1 weight percent of lithium-containing detergents and no more than 0.12 weight percent phosphorus, and provided the lubricating oil composition does not contain a calcium-containing detergent. The '263 application further discloses that the lubricating oil composition is useful for reducing catalyst poisoning in exhaust after treatment in internal combustion engines such as diesel engines, gasoline engines and natural gas engines.

It is desirable to develop improved natural gas engine lubricating oil compositions which can prevent or inhibit exhaust valve recession in natural gas fueled internal combustion engines.

SUMMARY OF THE INVENTION

In accordance with one embodiment of the present invention, a natural gas engine lubricating oil composition is provided comprising (a) a major amount of an oil of lubricating viscosity; and (b) an alkali metal-containing detergent, wherein the natural gas engine lubricating oil composition is substantially free of each of any alkaline earth metal-containing detergents and lithium-containing detergents.

In accordance with a second embodiment of the present invention, a natural gas engine lubricating oil composition is provided comprising (a) a major amount of an oil of lubricating viscosity; (b) an alkali metal-containing detergent; (c) one or more dispersants; (d) one or more antioxidants; and (e) one or more anti-wear agents, wherein the natural gas engine lubricating oil composition is substantially free of each of any alkaline earth metal-containing detergents and lithium-containing detergents.

In accordance with a third embodiment of the present invention, there is provided a method for preventing or inhibiting exhaust valve seat recession in a natural gas fueled engine, the method comprising lubricating the natural gas fueled engine with a natural gas engine lubricating oil composition comprising (a) a major amount of an oil of lubricating viscosity; and (b) an alkali metal-containing detergent, wherein the natural gas engine lubricating oil composition is substantially free of each of any alkaline earth metal-containing detergents and lithium-containing detergents.

In accordance with a fourth embodiment of the present invention, there is provided a method for enhancing the life of an exhaust valve in a natural gas fueled engine as evidenced by protection or inhibition in exhaust valve seat recession in the natural gas fueled engine, the method comprising lubricating the natural gas fueled engine with a natural gas engine lubricating oil composition comprising (a) a major amount of an oil of lubricating viscosity; and (b) an alkali metal-containing detergent, wherein the natural gas engine lubricating oil composition is substantially free of each of any alkaline earth metal-containing detergents and lithium-containing detergents.

In accordance with a fifth embodiment of the present invention, the use of a natural gas engine lubricating oil composition comprising (a) a major amount of an oil of lubricating viscosity; and (b) an alkali metal-containing detergent, wherein the natural gas engine lubricating oil composition is substantially free of each of any alkaline earth metal-containing detergents and lithium-containing detergents for the purpose of preventing or inhibiting exhaust valve seat recession in a natural gas fueled engine is provided. By lubricating a natural gas fueled engine with a natural gas engine lubricating oil composition comprising (a) a major amount of an oil of lubricating viscosity, and (b) an alkali metal-containing detergent, wherein the natural gas engine lubricating oil composition is substantially free of each of any alkaline earth metal-containing detergents and lithium-containing detergents, exhaust valve seat recession in a natural gas fueled engine is advantageously inhibited or prevented when the engine is lubricated with the lubricating oil composition.

DETAILED DESCRIPTION OF THE PREFERRED EMBODIMENTS

Definitions

As used herein, the following terms have the following meanings unless expressly stated to the contrary:

The term "hydrocarbyl" denotes a group having a carbon atom directly attached to the remainder of the molecule and having a hydrocarbon or predominantly hydrocarbon character within the context of this invention. Such groups include the following:

(1) Purely hydrocarbon groups: aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those, skilled in the art. Examples include methyl, ethyl, octyl, decyl, octadecyl, cyclohexyl, phenyl, etc.

(2) Substituted hydrocarbon groups: groups containing non-hydrocarbon substituents which do not alter the predominantly hydrocarbon character of the group. Those skilled in the art will be aware of suitable substituents. Examples include hydroxy, nitro, cyano, alkoxy, acyl, etc.

(3) Hetero groups: groups, while predominantly hydrocarbon in character, contain atoms other than carbon in a chain or ring otherwise composed of carbon atoms. Suitable hetero atoms will be apparent to those skilled in the art and include, for example, nitrogen, oxygen and sulfur. In general, no more than about three substituents or hetero atoms, and preferably no more than one, will be present for each 10 carbon atoms in the hydrocarbyl group.

The terms "hydrocarbon" and "hydrocarbon-based" have the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

The term "Base Number" or "BN" as used herein refers to the amount of base equivalent to milligrams of KOH in one gram of sample. Thus, higher BN numbers reflect more alkaline products, and therefore a greater alkalinity. BN was determined using ASTM D 2896 test.

The present invention is directed to a natural gas engine lubricating oil composition containing at least (a) a major amount of an oil of lubricating viscosity; and (b) a minor amount of an alkali metal-containing detergent, wherein the natural gas engine lubricating oil composition is substantially free of each of any alkaline earth metal-containing detergents and lithium-containing detergents. The natural gas engine lubricating oil composition is particularly useful for reducing exhaust valve seat recession in a natural gas fueled engine. The term "substantially free" as used herein shall be understood to mean only trace amounts, typically below 0.001 wt. %, based on the total weight of the lubricating oil composition, if any, of each of the alkaline earth metal-containing detergents and lithium-containing detergents in the lubricating oil compositions. Examples of alkaline-earth metal-containing detergents include calcium-containing detergents, barium-containing detergents, magnesium-containing detergents, strontium-containing detergents and the like. In one embodiment, the natural gas engine lubricating oil composition is substantially free of calcium-containing detergents.

In another embodiment, the natural gas engine lubricating oil composition is also substantially free of an alkaline earth metal salt of a condensation product of an alkylene polyamine, an aldehyde and a substituted phenol. The term "substantially free" for this embodiment being understood to mean only trace amounts, typically below 0.001 wt. %, based on the total weight of the lubricating oil composition, if any, of the alkaline earth metal salt of the condensation product is present in the lubricating oil compositions.

The natural gas engine lubricating oil composition according to the present invention will have a sulfated ash content of no more than about 1.5 wt. % as determined by ASTM D 874, preferably a sulfated ash content of no more than about 0.95 wt. % as determined by ASTM D 874 and most preferably a sulfated ash content of no more than about 0.5 wt. % as determined by ASTM D 874. In one embodiment, a lubricating oil composition according to the present invention for use in natural gas fueled engines has a sulfated ash content of about 0.1 wt. % to about 1.5 wt. % as determined by ASTM D 874, preferably about 0.12 wt. % to about 0.95 wt. % as determined by ASTM D 874 and most preferably about 0.15 wt. % to about 0.5 wt. % as determined by ASTM D 874. The lubricant ash advantageously acts as a solid lubricant to protect the valve/seat interface in place of naturally occurring exhaust particles in a hydrocarbon fueled engine.

In one embodiment, the natural gas engine lubricating oil compositions of the present invention are substantially free of any phosphorus, e.g., a phosphorus content not exceeding 0.08 wt. %, and more preferably not exceeding 0.05 wt. %. In another embodiment, the lubricating oil composition of the present invention contains relatively low levels of sulfur, i.e., not exceeding 0.7 wt. %, preferably not exceeding 0.5 wt. % and more preferably not exceeding 0.3 wt. %.

The internal combustion engines to which the present invention is applicable may be characterized as those operated on, i.e., fueled by, natural gas. Examples of such engines include four cycle engines and the like. In a preferred embodiment, the internal combustion engine is a stationary engine used in, for example, well-head gas gathering, compression, and other gas pipeline services; electrical power generation (including co-generation); and irrigation.

The oil of lubricating viscosity for use in the natural gas engine lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process. Examples of useful oils of lubricating viscosity include HVI and XHVI basestocks, such isomerized wax base oils and UCBO (Unconventional Base Oils) base oils.

The natural gas engine lubricating oil compositions of the present invention, which are substantially free of any alkaline earth metal-containing detergents and lithium-containing detergents, will also contain an alkali metal-containing detergent other than lithium-containing detergents. Suitable alkali metal-containing detergents include sodium and potassium-containing detergents. In general, the alkali metal-containing detergents for use in the natural gas engine lubricating oil compositions of the present invention are salts of, for example, organic sulfur acids, carboxylic acids, lactones or phenols. These salts may be neutral or overbased. The overbased alkali metal-containing detergents can be low or medium overbased alkali metal-containing detergents. The BN of the alkali metal-containing detergents can range from about 1 to about 200 and preferably about 1 to about 80.

The neutral salts contain an amount of metal cation just sufficient to neutralize the acidic groups present in the salt anion; whereas the overbased salts contain an excess of metal cation and are often termed basic, hyperbased or superbased salts. The terminology "metal ratio" is used herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt, the metal ratio is one and, in an overbased salt, the metal ratio is greater than one.

In one embodiment, the overbased salts used as the alkali metal-containing detergents in this invention may have metal ratios of at least about 1.2:1. In another embodiment, the overbased salts used as the alkali metal-containing detergents may have metal ratios of at least at least about 1.4:1. Often, the overbased salts have ratios of at least about 2:1, and in one embodiment at least about 4:1. However, the overbased salts may have metal ratios not exceeding about 20:1.

The organic sulfur acids are oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids may be represented for the most part by one of the following formulae I or II:

$$R^1(SO_3H)_r \quad (I)$$

$$(R^2)_xT(SO_3H)_y \quad (II)$$

wherein T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, and the like; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater. Specific examples of $R^1$ include groups derived from petrolatum, saturated and unsaturated paraffin wax, and polyolefins, including polymerized $C_2$-$C_6$ olefins containing from about 15 to about 7000 or more carbon atoms. The groups T, $R^1$ and $R^2$ in the above formulae can also contain other inorganic or organic substituents in addition to those enumerated above, e.g., hydroxy, mercapto, halogen, nitro, amino, nitroso, sulfide, disulfide, etc. The subscript x is generally 1-3, and the subscripts r and y generally have an average value of about 1-4 per molecule.

One class of examples of the oil-soluble sulfonic acids of Formulae I and II, include mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkylbenzene sulfonic acids (where the alkyl group has at least 8 carbons), cetylphenol mono-sulfide sulfonic acids, dicetyl thianthrenedisulfonic acids, dilauryl-betanaphthylsulfonic acids, and alkaryl sulfonic acids such as dodecylbenzene "bottoms" sulfonic acids. It is to be understood that for every sulfonic acid enumerated, it is intended that the corresponding neutral and basic metal salts thereof are also understood to be illustrated.

The alkaryl sulfonic acids are acids derived from benzene which has been alkylated with propylene tetramers or isobutene trimers to introduce 1, 2, 3, or more branched-chain $C_{12}$ substituents on the benzene ring. Dodecylbenzene bottoms, principally mixtures of mono- and di-dodecylbenzenes, are available as by-products from the manufacture of household detergents. Similar products obtained from alkylation bottoms formed during manufacture of linear alkylsulfonates (LAS) are also useful in making the alkali metal-containing sulfonate detergents used in this invention.

The production of sulfonates from detergent manufacture byproducts is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and methods for making them can be found in, for example, U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790; and 3,798,012. Also included are aliphatic sulfonic acids such as paraffin wax sulfonic acids, unsaturated paraffin wax sulfonic acids, hydroxy-substituted paraffin wax sulfonic acids, hexapropylenesulfonic acids, tetra-amylene sulfonic acids, polyisobutenesulfonic acids wherein the polyisobutene contains from about 20 to about 7000 or more carbon atoms, chloro-substituted paraffin wax sulfonic acids, nitro-paraffin wax sulfonic acids, etc; cycloaliphatic sulfonic acids such as petroleum naphthenesulfonic acids, cetylcyclopentyl sulfonic acids, laurylcyclohexylsulfonic acids, bis(di-isobutyl)cyclohexyl sulfonic acids, mono- or poly-wax substituted cyclohexylsulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

The carboxylic acids from which suitable neutral and basic alkali metal-containing salts may be made include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least about 8 carbon atoms, and in one embodiment at least about 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, alpha-linolenic acid, propylenetetramer-substituted maleic acid, behenic acid, isostearic acid, pelargonic acid, capric acid, palmitoleic acid, linoleic acid, lauric acid, oleic acid, ricinoleic acid, decanoic acid, undecanoic acid, dioctylcyclopentane carboxylic acid, myristic acid, dilauryldecahydro-naphthalene carboxylic acid, stearyl-octahydroindene carboxylic acid, palmitic acid, and commercially available mixtures of two or more carboxylic acids such as tall oil acids, rosin acids, and the like.

A useful group of oil-soluble carboxylic acids useful in preparing the salts used in the present invention are the oil-soluble aromatic carboxylic acids. These acids are represented by Formula III:

$$(R^*)_a—Ar^*(CXXH)_m \quad (III)$$

wherein R* is an aliphatic hydrocarbon-based group of at least 4 carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by Ar* include, by way of example, the polyvalent aromatic radicals derived from benzene, naphthalene, anthracene, phenanthrene, indene, fluorene, biphenyl, and the like. Generally, the group represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, and the like.

The R* groups in Formula III are usually purely hydrocarbyl groups, including groups such as alkyl or alkenyl radicals. However, the R* groups may contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., .=O), thio groups (i.e., .=S), interrupting groups such as —NH, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include, but are not limited to, butyl, isobutyl, pentyl, octyl, nonyl, dodecyl, docosyl, tetracontyl, 5-chlorohexyl, 4-ethoxypentyl, 2-hexenyl, e-cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

One class of useful carboxylic acids is of Formula: IV:

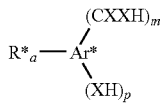

(IV)

wherein R*, X, Ar*, m and a have the aforestates meanings and p is an integer of 1 to 4, usually 1 or 2. Within this group, a useful class of oil-soluble carboxylic is of Formula V:

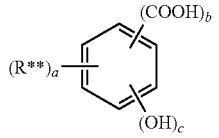

(V)

wherein R is an aliphatic hydrocarbon group containing at least 4 to about 400 carbon atoms, a is an integer of from 1 to 3, b is 1 or 2, c is zero, 1, or 2 and in one embodiment 1 with the proviso that R and a are such that the acid molecules contain at least an average of about 12 aliphatic carbon atoms in the aliphatic hydrocarbon substituents per acid molecule. And within this latter group of oil-soluble carboxylic acids, the aliphatic hydrocarbon substituted salicylic acids wherein each aliphatic hydrocarbon substituent contains an average of at least about 8 carbon atoms, and in one embodiment at least about 16 carbon atoms, per substituent and one to three substituents per molecule are particularly useful. A useful aliphatic-hydrocarbon substituted salicylic acid is $C_{16}$-$C_{18}$ alkyl salicylic acid. Salts prepared from aliphatic hydrocarbon substituted salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms may be used.

Carboxylic acids of the type illustrated by the above formulae and processes for preparing their neutral and basic metal salts are well known and disclosed in, for example, U.S. Pat. Nos. 2,197,832; 2,197,835; 2,252,662; 2,252,664; 2,714,092; 3,410,798 and 3,595,791, the contents of which are incorporated herein by reference.

Another type of neutral and basic carboxylate salt for use herein are those derived from hydrocarbon substituted succinic acids of general Formula VI:

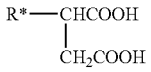

(VI)

wherein R* has the aforestated meaning. Examples of these salts are set forth in U.S. Pat. Nos. 3,271,130; 3,567,637 and 3,632,610.

Methods for making basic salts of sulfonic acids and/or carboxylic acids are well known, see, e.g., U.S. Pat. Nos. 2,501,731; 2,616,904; 2,616,905; 2,616,906; 2,616,911; 2,616,924; 2,616,925; 2,617,049, 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790; and 3,629,109.

Another group of carboxylic acid derivatives that are useful include the lactones represented by Formula VII:

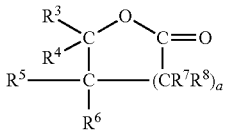

(VII)

wherein in $R^3$, $R^4$, $R^5$, $R^6$, $R^7$ and $R^8$ are independently H, hydrocarbyl groups or hydroxy substituted hydrocarbyl groups of from 1 to about 30 carbon atoms, with the proviso that the total number of carbon atoms must be sufficient to render the lactones oil soluble; $R^4$ and $R^5$ can be linked together to form an aliphatic or aromatic ring; and a is a number in the range of zero to about 4.

Another example of suitable alkali metal-containing detergents include neutral and basic salts of phenols (generally known as phenates) and are well known to those skilled in the art. The phenols from which these phenates are formed are of Formula VIII:

$$(R^*)_a—(Ar^*)—(OH)_m \quad \text{(VIII)}$$

wherein R*, a, Ar*, and m have the aforestated meanings. The same examples for R*, a, Ar*, and m described above with respect to Formula III also apply. A commonly available class of phenates are those made from phenols of Formula IX:

(IX)

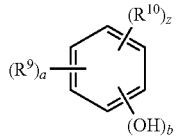

wherein a is an integer of 1-3, b is of 1 or 2, z is 0 or 1, $R^9$ is a substantially saturated hydrocarbon-based substituent having an average of from about 30 to about 400 aliphatic carbon atoms and $R^{10}$ is selected from the group consisting of lower alkyl, lower alkoxyl, nitro, and halo groups.

A class of phenates for use in this invention are the basic (i.e., overbased, etc.) alkali metal sulfurized phenates made by sulfurizing a phenol as described hereinabove with a sulfurizing agent such as sulfur, a sulfur halide, or sulfide or hydrosulfide salt. Techniques for making these sulfurized phenates are described in, for example, U.S. Pat. Nos. 2,680,096; 3,036,971 and 3,775,321.

Other phenates that are useful are those that are made from phenols that have been linked through alkalene (e.g., methylene) bridges. These are made by reacting single or multiring phenols with aldehydes or ketones in the presence of an acid or basic catalyst. Such linked phenates as well as sulfurized phenates are described in detail in, for example, U.S. Pat. No. 3,350,038.

Other useful alkali metal-containing detergents are the alkali metal alkylhydroxy benzoate detergents described in, for example, U.S. Patent Application Publication No. 20070027043, the contents of which are incorporated by reference herein. Generally, the alkali metal alkylhydroxybenzoates can have a structure as shown below in Formula X:

(X)

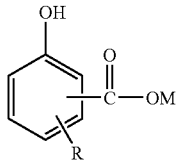

wherein R is a linear aliphatic group, branched aliphatic group or a mixture of linear and branched aliphatic groups and M is potassium or sodium. Preferably, R is an alkyl or alkenyl group. More preferably, R is an alkyl group. When R is a linear aliphatic group, the linear alkyl group typically comprises from about 12 to about 40 carbon atoms, and more preferably from about 18 to about 30 carbon atoms. When R is a branched aliphatic group, it typically comprises at least about 9 carbon atoms, preferably from about 9 to about 40 carbon atoms, more preferably from about 9 to about 24 carbon atoms and most preferably from about 10 to about 18 carbon atoms. Such branched aliphatic groups are preferably derived from an oligomer of propylene or butene.

R can also represent a mixture of linear or branched aliphatic groups. Preferably, R represents a mixture of linear alkyl containing from about 20 to about 30 carbon atoms and branched alkyl containing about 12 carbon atoms. When R represents a mixture of aliphatic groups, the alkali metal alkylhydroxybenzoates employed in the present invention may contain a mixture of linear groups, a mixture of branched groups, or a mixture of linear and branched groups. Thus, R can be a mixture of linear aliphatic groups, for example, an alkyl group selected from the group consisting of $C_{14}$-$C_{16}$, $C_{16}$-$C_{18}$, $C_{18}$-$C_{20}$, $C_{20}$-$C_{22}$, $C_{20}$-$C_{24}$ and $C_{20}$-$C_{28}$ alkyl and mixtures thereof, and is derived from normal alpha olefins. Advantageously, these mixtures include at least about 95 mole %, and preferably about 98 mole % of alkyl groups.

The alkali metal alkylhydroxybenzoates for use in the natural gas engine lubricating oil compositions of the present invention wherein R represents a mixture of alkyl groups, can be prepared from linear alpha olefin cuts, such as those marketed by Chevron Phillips Chemical Company under the names Normal Alpha Olefin $C_{26}$-$C_{28}$ or Normal Alpha Olefin $C_{20}$-$C_{24}$, by British Petroleum under the name $C_{20}$-$C_{26}$ Olefin, by Shell Chimie under the name SHOP C20-22, or mixtures of these cuts or olefins from these companies having from about 20 to 28 carbon atoms.

The —COOM group of Formula X can be in the ortho, meta or para position with respect to the hydroxyl group.

The alkali metal alkylhydroxybenzoates can be any mixture of alkali metal alkylhydroxybenzoates having the -COOM group in the ortho, meta or para position.

The alkali metal alkylhydroxybenzoates may be neutral or overbased. The BN of the high overbased alkali metal alkyhydroxybenzoates is generally greater than about 250, preferably from about 250 to about 450 and more preferably from about 300 to about 400 and will ordinarily have less than about 3 volume %, preferably less than about 2 volume % and more preferably less than about 1 volume % crude sediment. For the middle overbased alkali metal alkyhydroxybenzoates, the BN is from about 100 to about 250, and preferably from about 140 to about 230 and will generally have less than about 1 volume %, and preferably less than about 0.5 volume % crude sediment.

Generally, the overbased alkali metal alkyhydroxybenzoates can be prepared by overbasing the alkali metal alkyhydroxybenzoate or a mixture of alkali metal alkyhydroxybenzoate and up to 50 mole % of alkylphenol, based on the total mixture of alkyhydroxybenzoate and alkylphenol, with a molar excess of alkali metal base and at least one acidic overbasing material in the presence of at least one carboxylic acid having from one to four carbon atoms. The ovebasing step is ordinarily carried out in the presence of a solvent such as aromatic hydrocarbons, aliphatic hydrocarbons, monoalcohols, and the like and mixtures thereof.

Overbasing of the alkali metal alkyhydroxybenzoate or mixture of alkali metal alkyhydroxybenzoate and alkylphenol may be carried out by any method known by a person skilled in the art to produce overbased alkali metal alkyhydroxybenzoates. However, if desired, the addition of a small quantity of $C_1$-$C_4$ carboxylic acid at this step decreases the crude sediment obtained at the end of overbasing step by a factor of at least 3. The $C_1$-$C_4$ carboxylic acids used in the neutralization step include formic acid, acetic acid, propionic acid, and butyric acid, which may be used alone or in mixture. It is preferable to use mixtures of such acids as, for example, formic acid:acetic acid, in a molar ratio of formic acid:acetic acid of from about 0.1:1 to about 100:1, preferably from about 0.5:1 to about 4:1, more preferably from about 0.5:1 to about 2:1 and most preferably about 1:1.

Generally, the overbasing reaction is carried out in a reactor in the presence of alkylhydroxybenzoic acid from about 10 wt % to about 70 wt %, alkylphenol from about 1 wt % to about 30 wt %, diluent oil from about 0 wt % to about 40 wt %, an aromatic solvent from about 20 wt % to about 60 wt %. The reaction mixture is agitated. The alkali earth metal associated with an aromatic solvent, a monoalcohol and carbon dioxide are added to the reaction while maintaining the temperature between about 20° C. and 80° C.

The degree of overbasing may be controlled by the quantity of the alkali metal, carbon dioxide and the reactants added to the reaction mixture and the reaction conditions used during the carbonation process.

The weight ratios of reagents used (methanol, xylene, slaked lime and CO.sub.2) will correspond to the following weight ratios:

Xylene:slaked lime from about 1.5:1 to about 7:1, and preferably from about 2:1 to about 4:1.

Methanol:slaked lime from about 0.25:1 to about 4:1, and preferably from about 0.4:1 to about 1.2:1.

Carbon dioxide:slaked lime from a molar ratio about 0.5:1 to about 1.3:1, and preferably from about 0.7:1 to about 1.0:1.

$C_1$-$C_4$ carboxylic acid:alkylhydroxybenzoic acid a molar ratio from about 0.02:1 to about 1.5:1, and preferably from about 0.1:1 to about 0.7:1.

Lime is added as a slurry, i.e., as a pre-mixture of lime, methanol, xylene, and $CO_2$ is introduced over a period of about 1 hour to about 4 hours, at a temperature between about 20° C. and about 65° C.

The quantity of lime and $C_1$-$C_4$ are adjusted in order to obtain a high overbased material (BN>about 250) and crude sediment in the range of 0.4 to 3 volume %, and preferably in the range of 0.6 to 1.8 volume %, without any deterioration of the performance. With the omission of $C_1$-$C_4$ carboxylic acid, it is not able to reach this low level of crude sediment. Typically, crude sediment without a $C_1$-$C_4$ carboxylic acid will range from about 4 to 8 volume %.

For a middle overbased material (BN from about 100 to about 250), the quantity of lime and $C_1$-$C_4$ are adjusted in order to obtain a crude sediment in the range of about 0.2 to about 1 volume %. The crude sediment without the use of $C_1$-$C_4$ carboxylic acid will range from about 0.8 to about 3 volume %.

The alkali metal-containing detergents advantageously provide excellent inhibiting or prevention of exhaust valve seat recession in a natural gas fueled engine when incorporated into a lubricating oil composition. Generally, the amount of the alkali metal-containing detergent is present in the natural gas engine lubricating oil composition from about 0.5 wt. % to about 8.0 wt. %, and preferably from about 1.0 wt. % to about 6.0 wt. %, based on the total weight of the lubricating oil composition. In one embodiment, the alkali metal-containing detergent is a sodium-containing detergent present in the natural gas engine lubricating oil composition in an amount from about 0.5 wt. % to about 5.5 wt. %, and preferably from about 1.0 wt. % to about 3.0 wt. %, based on the total weight of the lubricating oil composition. In another embodiment, the alkali metal-containing detergent is a potassium-containing detergent present in the natural gas engine lubricating oil composition in an amount from about 0.5 wt. % to about 4.0 wt. %, and preferably from about 1.0 wt. % to about 2.0 wt. %, based on the total weight of the lubricating oil composition.

The natural gas engine lubricating oil compositions of the present invention further contain one or more of (c) one or more ashless dispersants, (d) one or more antioxidants, and/or (e) one or more anti-wear agents.

The one or more ashless dispersant compounds employed in the lubricating oil composition of the present invention are generally used to maintain in suspension insoluble materials resulting from oxidation during use, thus preventing sludge flocculation and precipitation or deposition on metal parts. Nitrogen-containing ashless (metal-free) dispersants are basic, and contribute to the Base Number or BN (as can be measured by ASTM D 2896) of a lubricating oil composition to which they are added, without introducing additional sulfated ash. An ashless dispersant generally comprises an oil soluble polymeric hydrocarbon backbone having functional groups that are capable of associating with particles to be dispersed. Many types of ashless dispersants are known in the art.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the Formula XI:

(XI)

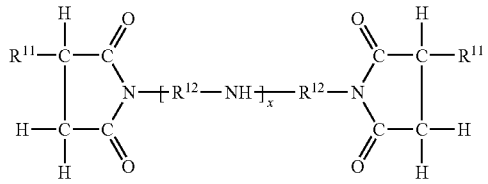

wherein each $R^{11}$ is independently a hydrocarbyl group, such as a polyolefin-derived group. Typically the hydrocarbyl group is an alkyl group, such as a polyisobutyl group. Alternatively expressed, the $R^{11}$ groups can contain about 40 to about 500 carbon atoms, and these atoms may be present in aliphatic forms. $R^{12}$ is an alkylene group, commonly an ethylene ($C_2H_4$) group. Examples of succinimide dispersants include those described in, for example, U.S. Pat. Nos. 3,172,892, 4.234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629. 3,591,598 and 3,980.569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2300, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In a preferred embodiment of the present invention, an ashless dispersant for use in the lubricating oil composition is a bis-succinimide derived from a polyisobutenyl group having a number average molecular weight of about 700 to about 2300. The dispersant(s) for use in the lubricating oil compositions of the present invention are preferably non-polymeric (e g., are mono- or bis-succinimides).

Generally, the one or more ashless dispersants are present in the natural gas engine lubricating oil composition in an amount ranging from about 1.0 to about 8.0 wt. %, and preferably from about 1.0 to about 6.0 wt. %, based on the total weight of the lubricating oil composition.

The one or more antioxidant compounds employed in the natural gas engine lubricating oil composition of the present invention reduce the tendency of base stocks to deteriorate in service, which deterioration can be evidenced by the products of oxidation such as sludge and varnish-like deposits on the metal surfaces and by viscosity growth. Useful antioxidants include hindered phenols, ashless oil soluble phenates and sulfurized phenates, diphenylamines, alkyl-substituted phenyl and naphthylamines and the like and mixtures thereof. Diphenyamine-type oxidation inhibitors include, but are not limited to, alkylated diphenylamine, phenyl-α-naphthylamine, and alkylated-α-naphthylmine.

Generally, the one or more antioxidant compounds are present in the natural gas engine lubricating oil composition in an amount ranging from about 0.1 to about 3.0 wt. %, and preferably from about 0.2 to about 2.5 wt. %, based on the total weight of the lubricating oil composition.

Examples of one or more anti-wear agents include, but are not limited to, phosphates and thiophosphates and salts thereof, carbamates, esters, and molybdenum complexes. Preferred anti-wear agents included in the lubricating oil composition of the present invention are metal di-alkyl dithiophosphates. However, it may be advantageous to control the amount of this additive because of its metal and phosphorus contribution to the lubricating oil. Examples of metal di-alkyl di-thiophosphates are zinc and molybdenum salts of di-alkyl di-thiophosphates. Most preferred anti-wear agents employed in the natural gas engine lubricating oil composition of the present invention are zinc di-alkyl di-thiophosphates.

Generally, the one or more anti-wear agents are present in the natural gas engine lubricating oil composition in an amount from about 0.1 wt. % to about 4.0 wt. %, and preferably from about 0.2 wt. % to about 3.0 wt. %, based on the total weight of the lubricating oil composition.

The natural gas engine lubricating oil compositions of the present invention can be conveniently prepared by simply blending or mixing the alkali metal-containing detergents, optionally with other additives, with the oil of lubricating viscosity. The alkali metal-containing detergents may also be preblended as a concentrate in the appropriate ratios to facilitate blending of a natural gas engine lubricating composition containing the desired concentration of additives. The alkali metal-containing detergents is blended with the base oil using a concentration at which they are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C. to 25° C.) can be measured by either actual precipitation from the oil composition or the formulation of a "cloudy" solution which evidences formation of insoluble wax particles.

The natural gas engine lubricating oil compositions of the present invention may also contain other conventional additives for imparting auxiliary functions to give a finished lubricating oil composition in which these additives are dispersed or dissolved. For example, the natural gas engine lubricating oil compositions may be blended with rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

The following non-limiting examples are illustrative of the present invention.

EXAMPLE A

A baseline formulation was formed containing 1.9 wt. % of a mono-succinimide (derived from a 1000 MW polyisobutenyl succinic anhydride (PIBSA)) and a mixture of heavy polyamine and diethylenetriamine, 1.1 wt. % of a bis-succinimide (derived from a 1300 MW PIBSA) and a mixture of heavy polyamine and diethylenetriamine, 2.25 mM/kg of a zinc dialkyl dithiophosphate derived from a primary alcohol, 0.14 wt. % of a sulfurized isobutylene (available from Afton Chemical Corporation as HiTEC 312), 0.05 wt. % of an alkyl dithiadiazole, 1.25 wt. % of a phenolic antioxidant, 5 ppm of a foam inhibitor and the balance being a Group II/SAE 40.

EXAMPLE 1

A baseline lubricating oil formulation was formed containing the same additives, base oil and treat rate as in Example A and then top-treated with 31.26 mM/kg of a sodium petroleum sulfonate (average molecular weight 550). The natural gas engine lubricating oil composition had a sulfated ash content of approximately 0.25 wt. % as determined by ASTM D874.

EXAMPLE 2

A baseline lubricating oil formulation was formed containing the same additives, base oil and treat rate as in Example A and then top-treated with 21.06 mM/kg of a potassium alkylhydroxybenzoate detergent (as prepared according to the method described in Example 1 of U.S. Patent Application Publication No. 2007/0027043). The natural gas engine lubricating oil composition had a sulfated ash content of 0.25 wt. % as determined by ASTM D 874.

COMPARATIVE EXAMPLE B

A baseline lubricating oil formulation was formed containing the same additives, base oil and treat rate as in Example A and then top-treated with 16.86 mM/kg of a sulfurized calcium phenate detergent (114 BN). The natural gas engine lubricating oil composition had a sulfated ash content of 0.25 wt. % as determined by ASTM D 874.

COMPARATIVE EXAMPLE C

A baseline lubricating oil formulation was formed containing the same additives, base oil and treat rate as in Example A and then top-treated with 19.10 mM/kg of a magnesium petroleum sulfonate detergent (405 BN). The natural gas engine lubricating oil composition had a sulfated ash content of about 0.25 wt. % as determined by ASTM D874.

COMPARATIVE EXAMPLE D

A baseline lubricating oil formulation was formed containing the same additives, base oil and treat rate as in Example A and then top-treated with 12.12 mM/kg of a sulfurized calcium phenate detergent (114 BN) and 4.75 mM/kg of a calcium alkylhydroxybenzoate detergent (115 BN). The natural gas engine lubricating oil composition had a sulfated ash content of about 0.25 wt. % as determined by ASTM D 874.

COMPARATIVE EXAMPLE E

A natural gas engine lubricating oil composition was formed by blending a commercial natural gas engine oil additive package with a Group II base oil. The natural gas engine oil additive package comprised a calcium detergent with other additives. The natural gas engine lubricating oil composition had a sulfated ash content of about 0.5 wt. % as determined by ASTM D 874.

COMPARATIVE EXAMPLE F

A natural gas engine lubricating oil composition was formed by blending an ashless commercial natural gas engine oil additive package with a Group II base oil.

Testing

The natural gas engine lubricating compositions of Examples 1 and 2 and the natural gas engine lubricating oil compositions of Comparative Examples B-F were evaluated for exhaust valve seat recession prevention efficacy in a Waukesha F11 GSID engine. In this test, a 6-cylinder Waukesha F11 GSID engine was instrumented in order to obtain dynamic voltage measurements from the 12 valves—6 intake and 6 exhaust valves. Each test was run for 400 hours using the lubricating compositions of Examples 1 and 2 and the lubricating oil compositions of Comparative Examples B-F and the average valve recession wear rates of the oils were calculated by a linear fit based on the last 300 hours of data from each test and reported on a wear rate per 1000 hours. The exhaust valve recession results are presented in Table 1. In this Table, lower valve wear recession rates represent greater exhaust valve seat recession prevention efficacy.

TABLE 1

Waukesha F11 Exhaust Valve Recession Results

| Ex./Comp. Ex. | Sulfated Ash (wt. %) | Average Exhaust Valve Wear Recession Rate (in/1000 hr) |
|---|---|---|
| 1 | 0.25 | −0.00177 |
| 2 | 0.25 | −0.00038 |
| B | 0.25 | 0.00065 |
| C | 0.25 | 0.00073 |
| D | 0.25 | 0.00053 |
| E | 0.50 | 0.00071 |
| F | 0 | 0.00277 |

As the data show, the natural gas engine lubricating oil compositions of Examples 1 and 2 containing an alkali metal-containing detergent exhibited superior prevention of exhaust valve recession over the lubricating oil compositions of Comparative Examples B-F containing either an alkaline earth detergent or no detergents at all.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method for preventing or inhibiting exhaust valve seat recession in a natural gas fueled engine, the method comprising lubricating a natural gas fueled engine in need of exhaust valve seat recession prevention or inhibition with a natural gas engine lubricating oil composition comprising (a) a major amount of an oil of lubricating viscosity; and (b) about 0.5 to about 4.0 wt. %, based on the total weight of the natural gas engine lubricating oil composition, of a low or medium overbased alkali metal-containing detergent having a BN from about 1 to about 200, wherein the low or medium overbased alkali metal-containing detergent is a potassium alkylhydroxybenzoate detergent and wherein the natural gas engine lubricating oil composition is substantially free of each of any alkaline earth metal-containing detergents and lithium-containing detergents, and further wherein the natural gas engine lubricating oil composition has a sulfated ash content of about 0.1 wt. % to about 0.5 wt. % as determined by ASTM D 874.

2. The method of claim 1, further including a sodium petroleum sulfonate detergent.

3. The method of claim 1, wherein the natural gas engine lubricating oil composition further comprises (c) one or more ashless dispersants, (d) one or more antioxidants; and (e) one or more anti-wear agents.

4. The method of claim 3, wherein the one or more ashless dispersants is a bissuccinimide.

5. The method of claim 4, wherein the bissuccinimide ashless dispersant is derived from one or ore polyalkylene succinic anhydrides.

6. The method of claim 3, wherein the one or more antioxidants is a hindered phenol compound.

7. The method of claim 3, wherein the one or more anti-wear agents is a zinc di-alkyl di-thiophosphate.

8. The method of claim 1, wherein the natural gas engine lubricating oil composition further comprises:

about 1.0 to about 8.0 wt. % of one or more ashless dispersants, about 0.1 to about 3.0 wt. % of one or more antioxidants, and about 0.1 to about 4.0 wt. % of one or more anti-wear agents, based on the total weight of the lubricating oil composition.

* * * * *